US007448565B2

(12) United States Patent
Farris

(10) Patent No.: US 7,448,565 B2
(45) Date of Patent: Nov. 11, 2008

(54) LOW PROFILE PRIMARY CLASSIFIER

(75) Inventor: Lawrence Scott Farris, East Granby, CT (US)

(73) Assignee: ALSTOM Technology Ltd, Baden (CH)

( * ) Notice: Subject to any disclaimer, the term of this patent is extended or adjusted under 35 U.S.C. 154(b) by 41 days.

(21) Appl. No.: 11/515,082

(22) Filed: Sep. 1, 2006

(65) Prior Publication Data

US 2008/0054112 A1 Mar. 6, 2008

(51) Int. Cl.
*B02C 15/00* (2006.01)

(52) U.S. Cl. ..... 241/119; 209/139.1

(58) Field of Classification Search ..... 241/117–121; 209/138–141

See application file for complete search history.

(56) References Cited

U.S. PATENT DOCUMENTS

| | | | |
|---|---|---|---|
| 3,465,971 | A | 9/1969 | Dalenberg et al. |
| 4,002,299 | A | 1/1977 | Skalka |
| 4,234,132 | A | 11/1980 | Maliszewski |
| 4,523,721 | A | 6/1985 | Maliszewski et al. |
| 4,602,745 | A | 7/1986 | Maliszewski et al. |
| 4,605,174 | A | 8/1986 | Maliszewski et al. |
| 4,752,037 | A | 6/1988 | Farris et al. |
| 4,907,751 | A | 3/1990 | Wark et al. |
| 7,100,853 | B2 * | 9/2006 | Wark ..... 241/119 |

FOREIGN PATENT DOCUMENTS

| | | |
|---|---|---|
| WO | WO00/51740 | 9/2000 |

OTHER PUBLICATIONS

PCT International Search Report dated May 2, 2008—(PCT/US2007/073652).
Written Opinion of the International Search Authority dated May 2, 2008—(PCT/US2007/073652).

* cited by examiner

*Primary Examiner*—Mark Rosenbaum
(74) *Attorney, Agent, or Firm*—Timothy J. Olson

(57) ABSTRACT

A primary classifier (300) particularly suited for use in a bowl mill (10) of the type that is employed for purposes of effecting the pulverization of materials such as coal is provided by the present invention. The primary classifier (300) includes a vane wheel portion (360) affixed to the periphery of the rotatable grinding surface (14) of the bowl mill (10) so as to extend circumferentially around the entire interior of the substantially closed separator body (12) of the bowl mill (10). The primary classifier (300) further includes a low profile deflector portion (380) mounted within the interior of the substantially closed separator body (12) of the bowl mill (10) in closely spaced relation to the circumference of the rotatable grinding surface (14) at an elevation below the elevation of the grinding journal openings (205) and so as to extend continuously without interruption about the entire interior of the substantially closed separator body (12) of the bowl mill (10).

13 Claims, 5 Drawing Sheets

LOW PROFILE PRIMARY CLASSIFIER

FIELD OF THE INVENTION

The present invention is directed to a primary classifier for use in a bowl mill type pulverizer, and more particularly, to such a primary classifier for use in a bowl mill type pulverizer wherein the primary classified includes a vane wheel portion and a low profile deflector portion.

BACKGROUND OF THE INVENTION

Pulverizers for grinding different type materials are well known in the prior art. Coal is one such material wherein there exists a need to grind the material in order to render it suitable for use in certain applications. Fossil fuel fired power generation systems represent one such application in which it is desired to employ pulverized coal as the fuel. Such a system is commonly referred to as a coal fired power generation system.

For purposes of the discussion that follows, the coal fired power generation systems referred to above typically include the following major operating components: a coal feeder, an apparatus for pulverizing coal, a distribution system for distributing the pulverized coal, a furnace in which the pulverized coal is to be burned, and the requisite controls for effecting the proper operation of the coal fired power generation system. Of particular interest herein is the apparatus for pulverizing coal, which will often be referred to hereinbelow as a coal pulverizer. Coal pulverizers are not new. They have been known to exist in the prior art for more than half a century. Furthermore, many improvements have been made in the construction and/or mode of operation of coal pulverizers during this period. There are a number of features that it is advantageous for any coal pulverizer to possess, but particularly those which are designed for employment in a coal fired power generation system. Reference is had here to features such as reliability, low power consumption, minimum maintenance and a wide range of capacity. In addition, such a coal pulverizer advantageously should also be characterized by quiet operation, integrated lubrication systems, convenient adjustment and control of coal flow and fineness, and the ability to handle the high temperature air that is required for purposes of effecting therewith the drying to some degree of the high moisture coal that is to be pulverized in the coal pulverizer.

One particular type of conventional coal pulverizer is that which is commonly referred to in the industry as a bowl mill. Such a coal pulverizer obtains its name by virtue of the fact that the pulverization, i.e., grinding, of the coal, which takes place therein, is effected on a grinding surface that insofar as the configuration thereof is concerned bears a resemblance to a bowl. By way of exemplification and not limitation, reference may be had in this regard to U.S. Pat. No. 3,465,971, which issued Sep. 9, 1969 to J. F. Dalenberg et al., and/or U.S. Pat. No. 4,002,299, which issued Jan. 11, 1977 to C. J. Skalka, both of the latter patents being assigned to the same assignee as the instant application, for a teaching of the nature of the construction and the mode of operation of a prior art form of bowl mill that is suitable for use in a coal fired power generation system to effectuate the pulverization of the coal that is to be burned as fuel therein. As taught by the aforereferenced U.S. patents, a bowl mill essentially includes a body portion in which a grinding table is mounted for rotation, a plurality of grinding rollers that interact with the grinding table to effect the grinding of coal interposed therebetween, coal supply means for feeding to the interior of the bowl mill the coal that is to be pulverized therein, and air supply means for supplying to the interior of the bowl mill the air required for purposes of the operation of the bowl mill. In accordance with the mode of operation of such a bowl mill, the coal, which enters the bowl mill, is pulverized by virtue of the interaction of the grinding rollers with the grinding table. After being pulverized, the coal particles are thrown outwardly by centrifugal force, whereby the particles are fed into a stream of air that is made to enter the bowl mill. This stream of air, which now contains pulverized coal particles, flows through a tortuous path that is established in part by the positioning within the bowl mill of a suitably supported deflector means. As the stream of air and coal particles flows along the aforereferenced tortuous path, the sharp turns contained therein function to effect the separation of the coarse coal particles from the air stream. These coarse coal particles, which have been separated from the air stream, are then suitably returned to the grinding table for further pulverization, while the fine coal particles, which remain entrained in the air stream, are carried through the bowl mill in the air stream, and exit from the bowl mill along with the air stream.

Although bowl mills constructed in accordance with the teachings of the aforementioned U.S. patents have under actual operating conditions provided adequate performance, a need has nevertheless been evidenced for improvements to be made thereto. More specifically, prolonged operation of this type of bowl mill has revealed the existence of several undesirable conditions. One of these undesirable conditions is related to the need for and the manner in which a primary classification is had within the bowl mill of the material that is being pulverized. As employed herein the term primary classification is intended to refer to the separation of pulverized material from the air stream in which such material is entrained. In particular, reference is had here to that separation of pulverized material which occurs as a consequence of causing the air stream, within which the pulverized material is entrained, to follow a tortuous path through the bowl mill, whereby in the course of changing directions of flow as necessitated by the nature of this torturous path the larger of the particles of the pulverized material lose their momentum and are made to return to the surface of the grinding table whereat they are subjected to further pulverization.

In accordance with the teachings of the prior art, it has been known to employ a separator body liner design in a bowl mill for purposes of accomplishing the aforedescribed primary classification of pulverized material therewithin. In this regard, by way of exemplification and not limitation, such a bowl mill comprises the subject matter of U.S. Pat. No. 4,234,132, which issued on Nov. 18, 1980 and which is assigned to the same assignee as the present application. Although a bowl mill equipped with such a separator body liner design has proven to be adequate in terms of accomplishing the desired primary classification of the pulverized materials, disadvantages associated with the employment thereof have nevertheless been encountered, such as, including but not limited thereto, limited access to the internal workings of such a bowl mill due to the positioning of the deflector therein and the creation of undesirable wear distribution patterns within the interior of such a bowl mill.

To address these problems, the invention described in U.S. Pat. No. 4,523,721, which issued Jun. 18, 1985 to Theodore V. Maliszewski et al., and which is assigned to the same assignee as the instant application, and is incorporated herein in its entirety, was developed. In the Maliszewski et al. invention primary classification is had through the use of both a non-continuous vane wheel and an associated non-continuous deflector.

With reference to FIG. 1, the vane wheel 100 is supported on the periphery of a rotatable grinding table 14 of the bowl mill 10 by any suitable conventional form of fastening means, such as through the use of threaded fasteners 42. The vane wheel 100 is operative, when the air stream mixes with the coal particles as the air stream flows in surrounding relation to the grinding table 14, to cause the air steam to change direction and to flow counterclockwise to the direction of rotation of the grinding table 14. This in turn has the effect of causing pulverized material, which may be entrained in this air stream, to be carried in a direction, which is opposite to the direction of rotation of the grinding table 14, such that the larger of the particles of pulverized material lose their momentum, and separate from the air stream, and as a consequence thereof are returned to the surface of the grinding table 14 for additional pulverization.

As will be more fully described hereinafter, the non-continuous deflector 38 is mounted within the interior of the bowl mill 10 above and in spaced relation to the surface of the grinding table 14. The non-continuous deflector 38, as a consequence of being so mounted, is operative to cause the air stream, which has pulverized material entrained therein, to be directed toward the center of the interior of the bowl mill 10. This constitutes a change in the direction of flow of the air stream and is effective in causing the larger, i.e., heavier, particles of pulverized material, e.g., coal, entrained in the air stream to lose their momentum and to separate out of the air stream, and to thus be returned to the surface of the grinding table 14 for further pulverization.

The non-continuous deflector 38, as will be best understood with reference to FIG. 2, encompasses the following components: intermediate liner support plate 58, deflector liner support plate 60, intermediate liner 62, deflector liner 64 and deflector side liner 66*a*. Three such intermediate liner support plates 58 are preferably utilized, only one thereof, however, being visible in FIG. 2 of the drawing. The reason three intermediate support plates 58 are utilized is that the non-continuous deflector 38 is, as the name implies, not continuous around the interior of the bowl mill 10. Rather, the non-continuous deflector 38 is suitably provided with open areas that are located in juxtaposed relation to each of the three grinding journal openings/doors 205. Each of the intermediate liner support plates 58 is suitably located so as to be centered relative to a respective one of the grinding journal openings/doors 205.

The deflector liner support plates 60 are positioned such that the deflector liner support plates 60 occupy the area that extends between each pair of adjoining grinding journal openings/doors 205. Inasmuch as the bowl mill 10 is provided with three such grinding journal openings/doors 205, a like number, i.e., three such deflector liner support plates 60, are commonly employed in the bowl mill 10.

Each of the deflector liner support plates 60 has affixed thereto a deflector side liner. As best understood with reference to FIG. 2 of the drawings, each such deflector side liner is identified in FIG. 2 by the reference numeral 66*a*. In this regard, each such deflector side liner 66*a* is suitably positioned so that preferably the back edge thereof is flush with the interior surface of the separator body 12 and so that the bottom edge of each such deflector side liner 66*a* is arranged such as to be flush with the intermediate liner support plate 58, which has been previously described herein.

Each of the intermediate liner support plates 58, as best understood with reference to FIG. 2 of the drawings, has a multiplicity of intermediate liners 62 mounted thereon. To this end, these intermediate liners 62 are suitably positioned so as to be located below the grinding journal openings/doors 205. To complete the description of the non-continuous deflector 38, the non-continuous deflector 38 includes a bottom row of deflector liners 64 that is installed as a component thereof as well as a middle row of deflector liners 64 that is installed in mounted relation on the deflector liner support plates 60. In addition, there is also installed as a component of the non-continuous deflector 38 a top row of deflector liners 64.

While this design, as described hereinbefore in conjunction with the illustration thereof as depicted by way of exemplification and not limitation in FIGS. 1 and 2 of the drawings, has successfully enjoyed over twenty years of use, certain problems therewith have nevertheless arisen during this time. For example, it has been found that due to the vertical location at which the non-continuous deflector 38 is mounted above the grinding table 14 within the bowl mill 10, the liners 64, of which the non-continuous deflector 38 is comprised, are subjected to eroding due to these liners 64 being impinged upon by the coal that is entrained in the air stream. Accordingly, there exists a need for a new and improved primary classifier, which is capable of withstanding the erosion caused by the coal entrained in the air stream impinging thereagainst. Also, due to the vertical placement of the non-continuous deflector 38, as well as the volume of space occupied thereby, access to the interior of the bowl mill 10 for maintenance and repair purposes has been found to be somewhat limited. Accordingly, in addition there exists a need for a primary classifier design, which allows for greater access to the interior of a bowl mill.

Another problem associated with prior art designs of primary classifier results from the fact that the vane wheel 100 is not completely uniform around the entire perimeter of the bowl mill 10. Coupled with this is the fact that because of the sectioning of the vane wheel 100, the air streams with the coal entrained therein are channeled. Such channeling in turn produces high wear areas, as well as stratification of the coal flow. Such coal flow stratification reduces the efficiency that one is able to realize with the primary classifier. Accordingly, there also exists a need for a primary classifier in which there is no stratification of the coal flow.

OBJECTS OF THE INVENTION

It is an object of the present invention to provide a primary classifier, which is capable of withstanding the erosion from the coal entrained in the air stream.

It is also an object of the present invention to provide a primary classifier in which the air streams with the coal entrained therein are not channeled.

Still another object of the present invention is to provide a primary classifier, which does not restrict access to the interior of a bowl mill, particularly when such access is required for maintenance and repair purposes.

The above-stated objects, as well as other objects, features, and advantages, of the present invention will become readily apparent from the following detailed description when read in conjunction with the appended drawings.

SUMMARY OF THE INVENTION

In accordance with the present invention, there is provided a new and improved primary classifier for a bowl mill of the type that has a substantially closed separator body as well as a grinding surface, which is located inside the separator body such as to thereby rotate in a first direction. Such a bowl mill, in known fashion, is operative for purposes of effecting the pulverization of material, such as coal, on the grinding surface thereof. Such a bowl mill commonly includes a plurality of grinding rolls; namely, three such grinding rolls equally spaced one to another within the interior of the closed separator body of such a bowl mill. These grinding rolls are designed to interact with the grinding surface of such a bowl mill for purposes of effecting therebetween the pulverization of material, such as coal. Each such grinding roll is located in juxtaposed relation to a grinding journal opening suitably formed for this purpose in the separator body of such a bowl mill. Continuing, an annular passage is suitably provided in such a bowl mill between the closed separator body and the circumference of the grinding surface thereof.

The primary classifier in accordance with the present invention includes a vane wheel portion and a low profile deflector portion wherein the vane wheel portion is mounted on the periphery of the grinding table of such a bowl mill so that the vane wheel portion will rotate with the grinding table in a first direction. Such rotation of the vane wheel portion causes the air stream that flows through the aforementioned annular passage and over the aforesaid grinding surface to change direction. Because of this change in direction in the flow of the air stream the larger particles of pulverized material entrained in this air stream to lose their momentum and to separate from the air stream for return to the aforesaid grinding surface for additional pulverization.

The low profile deflector portion is mounted within the bowl mill so that the low profile deflector portion extends continuously around the inside of the closed separator body. The mounting of the low profile deflector portion is such that the low profile deflector portion also extends below each of the grinding journal openings. The low profile deflector portion is operative to cause the air stream, which is flowing though the interior of the bowl mill, to be directed toward the center of the bowl mill, which in turn is effective to cause the larger particles of pulverized material, which are entrained in this air stream, to lose their momentum and as a consequence thereof these larger particles of pulverized material separate from the air stream so as to thereby cause them to return to the grinding surface of the bowl mill for further pulverization.

In accordance with one aspect of the present invention, the low profile deflector portion of the primary classifier of the present invention includes multiple segments of upper liner portions, multiple middle liners, and in most cases includes lower liners as well. With further regard to this aspect of the present invention, these multiple segments of upper liner portions are continuous around the inside of the closed separator body. Thus, these multiple segments of upper liner portions thereby form an upper ring. The multiple middle liners on the other hand are continuous around the inside of the closed separator body at a location below the upper ring. As such, the multiple middle liners are operative to form therefrom a middle ring. Also, to the extent that there are lower liners, such lower liners are continuous around the inside surface of the closed separator body at a location below the middle ring, and accordingly such lower liners are thereby operative to form therefrom a lower ring.

Continuing, the upper ring that is formed by the multiple segments of upper liner portions has an upper edge and a lower edge, and with the upper edge of the upper ring being positioned closer to the interior surface of the closed separator body than is the lower edge of the upper ring. That is, the upper ring is angled downward toward the center of the closed separator body. In addition, in accordance with this aspect of the present invention, the middle ring that is formed by the multiple middle liners also has an upper edge and a lower edge, and with the lower edge of the middle ring being positioned closer to the interior surface of the closed separator body than is the upper edge of the middle ring. Accordingly, the middle ring is angled upward toward the center of the closed separator body, while further, the upper ring is angled downward toward the center of the bowl mill, such as, for example, at an angle of 45°.

In accordance with yet another aspect of the present invention, the middle liners are positioned so as to be in contact with the multiple segments of the upper liner portions, and to the extent that there are lower liners present, the middle liners are positioned so as to be in contact with such lower liners as well. To this end, the bottom of the multiple segments of upper liner portions are positioned so as to be in contact with the top of the middle liners, while the bottom of the middle liners are positioned so as to be in contact with the top of the lower liners, to the extent that such lower liners are present. According to still another aspect of the present invention, in accordance therewith each of the liner portions and liners is preferably affixed directly to the interior of the closed separator body such as, for example, by being welded thereto, i.e., no mounting hardware is employed for this purpose, except for those applications wherein such liner portions and liners are castings. In yet another aspect of the present invention, in accordance therewith each such liner portion and liner is preferably formed from an abrasion resistant material.

In still another aspect of the present invention, a vane wheel portion is provided that is mounted in spaced relation around the circumference of a grinding table. In accordance therewith, this vane wheel portion is mounted so as to project outwardly from such a grinding table. This vane wheel portion is operative, as the aforesaid grinding table rotates through 360°, to effect therewith the change in direction of the air stream, which has been discussed hereinabove previously.

According to yet a further aspect of the present invention, such a vane wheel portion generally also includes a plurality of vane liners. To this end, such vane liners are intended to be replaceable plates that are designed to protect the vanes from wear, there preferable being in accordance with this aspect of the invention one such liner per each vane.

In a still further aspect of the present invention, such a vane wheel portion may also include one or more of the following: wingtips and a vane wheel inner shroud liner with preferably all being made from abrasion resistant materials. Such wingtips, which extend off of the back of the vanes of such a vane wheel portion, are designed to be used to adjust therewith the air stream velocity through such a vane wheel portion for purposes of achieving the proper entrainment therein of the pulverized material, there preferably being in accordance with this aspect of the present invention one such wingtip per each vane. Such a vane wheel inner shroud liner is provided as a means of protecting the fastener heads and inner ring of such a vane wheel portion from wear. There is preferably provided in accordance with this aspect of the present invention one such vane wheel inner shroud liner per each section of the vane wheel portion. Continuing, each such vane wheel inner shroud liner is designed to be welded to the inner shroud of such a vane wheel portion after such a vane wheel portion has been installed within the interior of a bowl mill.

BRIEF DESCRIPTION OF THE DRAWINGS

In order to facilitate a fuller understanding of the present invention, reference is now made to the appended drawings. These drawings should not be construed as limiting the present invention, but are intended to be illustrative thereof only.

DETAILED DESCRIPTION OF A PREFERRED EMBODIMENT

Figure 3:
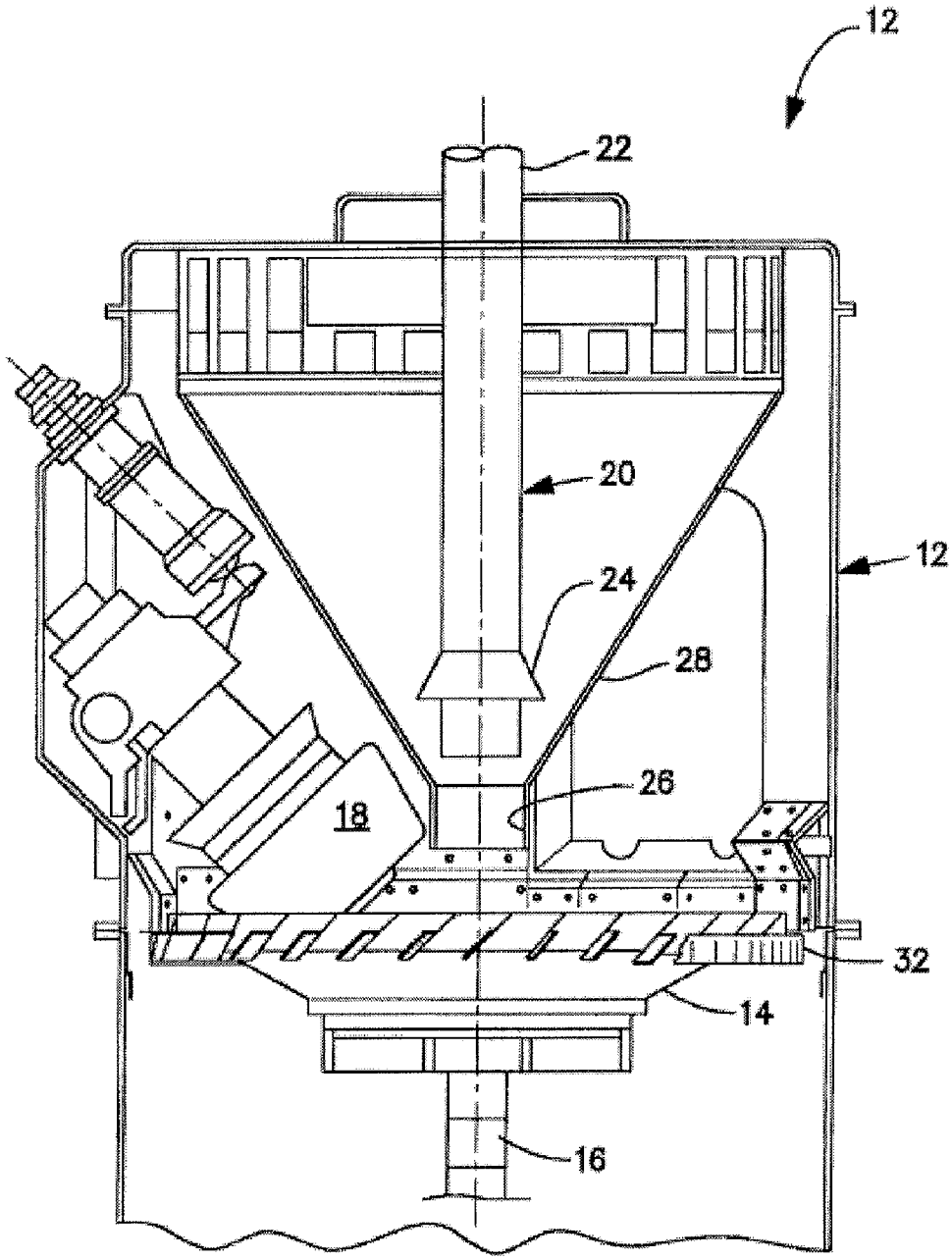
Figure 3 (Prior Art)
FIG. 3 is a side elevation view partially in section of a bowl mill type pulverizer embodying a prior art form of primary classifier.

FIG. 3 of the drawings depicts a pulverizing bowl mill, generally designated by reference numeral 10, constructed in accordance with the prior art. Inasmuch as the nature of the construction and the mode of operation of pulverizing bowl mills are known to those skilled in the art, it is not deemed necessary to set forth a detailed description of the pulverizing bowl mill 10 illustrated in FIG. 3 of the drawings. Rather, it is deemed sufficient for purposes of obtaining an understanding of the pulverizing bowl mill 10 embodying a prior art form of primary classifier to merely present herein a description of the nature of the construction and the mode of operation of the components of the pulverizing bowl mill 10 with which the aforesaid primary classifier cooperates. For a more detailed description of the nature of the construction and the mode of operation of the components of the pulverizing bowl mill 10 which are not described in depth herein one may have reference to the prior art, including, but not limited to, U.S. Pat. No. 3,465,971, which issued Sep. 9, 1969 to J. F. Dalenberg et al., and/or U.S. Pat. No. 4,002,299, which issued Jan. 11, 1977 to C. J. Skalka.

With further reference to FIG. 3 of the drawings, the pulverizing bowl mill 10 as illustrated therein includes a substantially closed separator body 12. Continuing, as shown therein a grinding table 14 is mounted on a shaft 16, which in turn is operatively connected to a suitable drive mechanism (not shown in the interest of maintaining clarity of illustration in the drawings) so as to be capable of being rotatably driven thereby. With the aforementioned components arranged within the substantially closed separator body 12 in the manner depicted in FIG. 3 of the drawings, the grinding table 14 is operative so as to be driven in a clockwise direction.

Continuing with the description of the pulverizing bowl mill 10, which is illustrated in FIG. 3 of the drawings, a plurality of grinding rolls 18, preferably three in number in accord with conventional practice, are suitably supported within the interior of the substantially closed separator body 12 so as to be equidistantly spaced one from another around the circumference of the substantially closed separator body 12. In the interest of maintaining clarity of illustration in the drawings, only one such grinding roll 18 has been shown in FIG. 3 of the drawings.

The material, e.g., coal, that is to be pulverized in the bowl mill 10, which is constructed in accordance with the illustration thereof in FIG. 3 of the drawings, is fed thereto by means of any conventional form of feed means that is suitable for use for such a purpose. Upon being discharged from such a feed means (not shown in the interest of maintaining clarity of illustration in the drawings) the coal enters the bowl mill 10 by means of a coal supply means, generally designated by reference numeral 20, with which the substantially closed separator body 12 is suitably provided. In accordance with the embodiment of the pulverizing bowl mill 10 illustrated in FIG. 3 of the drawings, the coal supply means 20 includes a suitably dimensioned duct 22 having one end thereof which extends outwardly of the substantially closed separator body 12 and preferably terminates in a funnel-like member (not shown in the interest of maintaining clarity of illustration in the drawings). The latter funnel-like member (which is not shown in the drawings) is suitably shaped so as to facilitate the collection of the coal particles entering the bowl mill 10, and the guiding thereafter of these coal particles into the duct 22.

The other end 24 of the duct 22, as best understood with reference to FIG. 3 of the drawings, is operative to effect the discharge of coal onto the surface of the grinding table 14. To this end, as shown in FIG. 3 of the drawings, the other end 24 of the duct 22 preferably is suitably supported within the substantially closed separator body 12 through the use of any form of conventional support means (not shown), which is suitable for use for such a purpose, such that the other end 24 of the duct 22 is coaxially aligned with the shaft 16 to which reference has previously been had hereinbefore, which is operative to support the grinding table 14 for rotation. Furthermore, the other end 24 of the duct 22 is located in spaced relation to a suitable outlet 26 provided in the classifier, generally designated by reference numeral 28 in FIG. 3 of the drawings, through which the coal is made to flow in the course of being fed onto the surface of the grinding table 14.

In accordance with the mode of operation of the pulverizing bowl mill 10, which is constructed in accordance with the illustration thereof in FIG. 3 of the drawings, a gas, which most commonly is in the form of air, is utilized to effect the conveyance of the coal from the grinding table 14 through the interior of the substantially closed separator body 12 for discharge from said pulverizing bowl mill 10. The air that is employed for this purpose is made to enter the substantially closed separator body 12 through an opening (not shown in the interest of maintaining clarity of illustration in the drawings), which is suitably provided for this purpose I the substantially closed separator body 12. From the aforementioned opening (which is not shown in the drawings) in the substantially closed separator body 12, the air flows from beneath the grinding table 14 in surrounding relation thereto to above the surface of the grinding table 14. More specifically, as will be best understood with reference to FIG. 3 of the drawings, such air flows through the space, identified by the reference numeral 32 in FIG. 3 of the drawings, that for this purpose is provided between the inner wall surface of the substantially closed separator body 12 and the circumference of the grinding table 14. The path of flow that the air follows thereafter will be described more fully hereinafter in connection with the description of a primary classifier constructed in accord with the present invention with which a prior art form of bowl mill, such as the pulverizing bowl mill 10, which has been described hereinbefore and which is illustrated in FIG. 3 of the drawings, is capable of being equipped.

As the air is made to flow through the interior of the bowl mill 10, which is constructed in accordance with the illustration thereof in FIG. 3 of the drawings, the coal that is disposed on the surface of the grinding table 14 is being pulverized by the cooperative action between the grinding rolls 18 and the surface of the grinding table 14. As the coal becomes pulverized in the aforedescribed manner, the particles of coal that are created as a result of such pulverization are thrown as a result of centrifugal force outwardly away from the center of the grinding table 14. Thereupon, these particle of coal, upon reaching the circumferential region of the grinding table 14, are picked up by the air flowing upwardly from beneath the grinding table 14 through the space 32, and these particles of coal become entrained in this flow of air and are carried away therewith. Thereafter, this flow of air, with these particles of coal entrained therein, follows a tortuous path through the interior of the bowl mill 10, which is constructed in accordance with the illustration thereof in FIG. 3 of the drawings. Moreover, in the course of following this tortuous path the larger ones of these particles of coal are caused to be separated from the flow of air in which these larger particles of coal have become entrained, and thus are made to return to the surface of the grinding table 14 whereupon these larger particles of coal undergo further pulverization. On the other hand, the lighter ones of these particles of coal that are entrained in the flow of air continue to be carried along entrained in the flow of air. Ultimately, the combined flow of air and those lighter particles of coal that remain entrained in the flow of air proceed in an upwardly direction, as viewed with reference to FIG. 3 of the drawings, to the classifier 28.

In accord with conventional practice and in a manner which is well-known to those skilled in this art, the classifier 28 is designed to be operative to effect therewith a further sorting of the particles of coal that remain entrained in the flow of air that reaches the classifier. Namely, those particles of pulverized coal, which are of the desired particle size, are permitted to pass through the classifier 28 and along with the flow of air are then discharged therefrom and thus from the bowl mill 10 as well as through the outlets (not shown in the interest of maintaining clarity of illustration in the drawings), with which the bowl mill 10 is suitable provided for this purpose. On the other hand, those particles of coal, which are larger in size than desired, are returned to the surface of the grinding table 14 in order that they may be made to undergo additional pulverization. Thereafter, these particles of coal that have been returned to the surface of the grinding table 14 are subjected to a repeat of the pulverization process, which has been described above previously. That is, these larger particles of coal, which have been returned to the surface of the grinding table 14 for further pulverization, are thrown under the influence of centrifugal force outwardly of the grinding table 14, are then picked up by the flow of air exiting from beneath the grinding table 14 after flowing upwardly through the space 32, are next carried along entrained within the flow of air through the interior of the bowl mill 10, and as this flow of air follows, as previously described hereinbefore, the tortuous path to which reference has been had herein previously, the larger particles of coal drop back onto the grinding table 14, the lighter particles of coal though continue to be carried along entrained within the flow of air to the classifier 28, while those particles of coal, which are of the desired size are permitted to pass through the classifier 28 and are made to exit from the bowl mill 10 through the outlets (not shown in the interest of maintaining clarity of illustration in the drawings), which are suitably provided for this purpose in the bowl mill 10.

Figure 4:
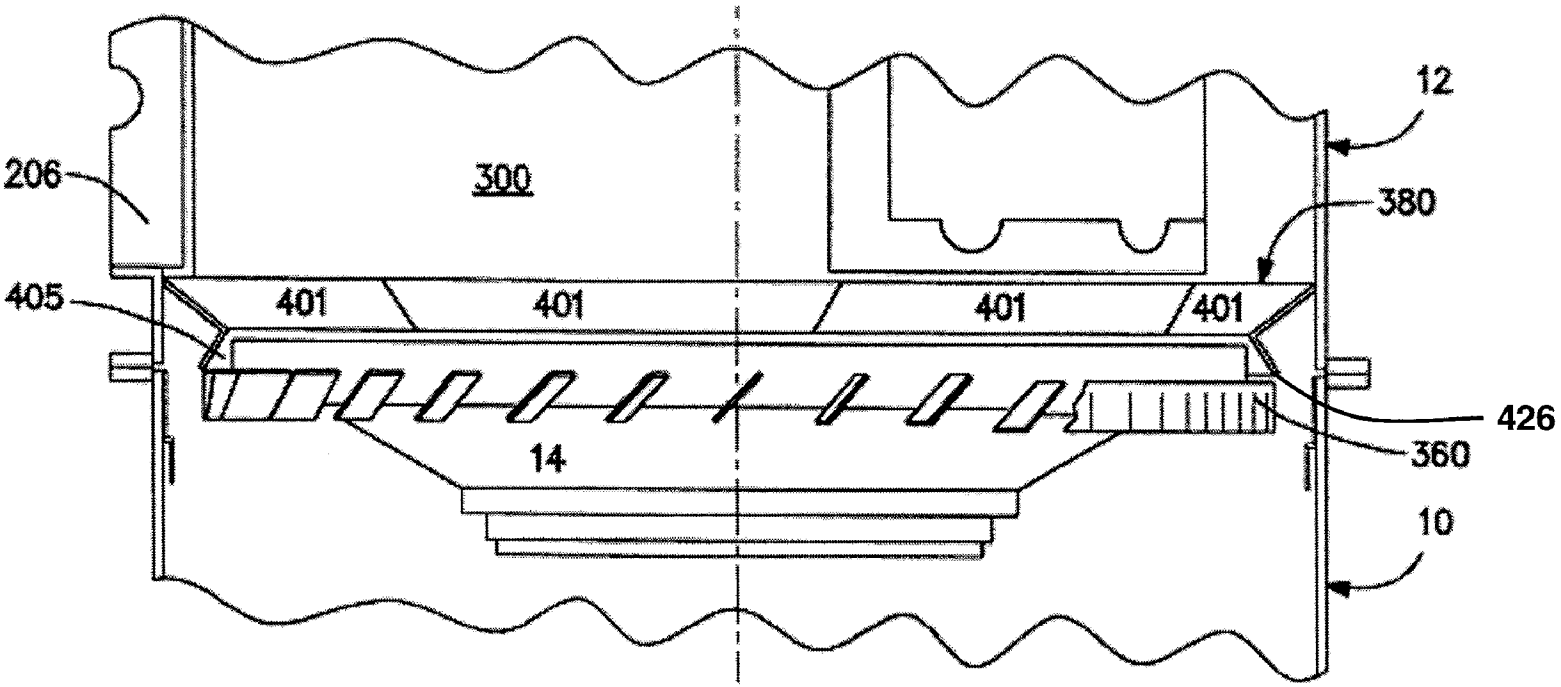
FIG. 4 is a side elevation view of a primary classifier constructed in accordance with the present invention.
Figure 5:
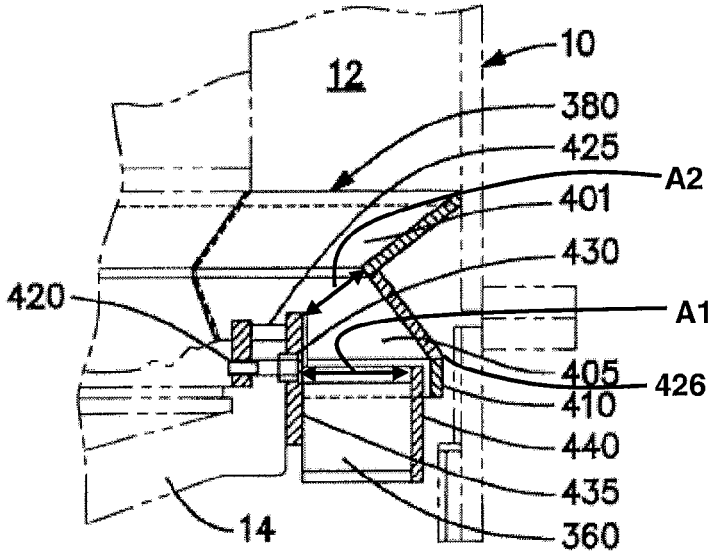
FIG. 5 is a side elevation view partially in section of a portion of the primary classifier constructed in accordance with the present invention of FIG. 4.
Figure 6:
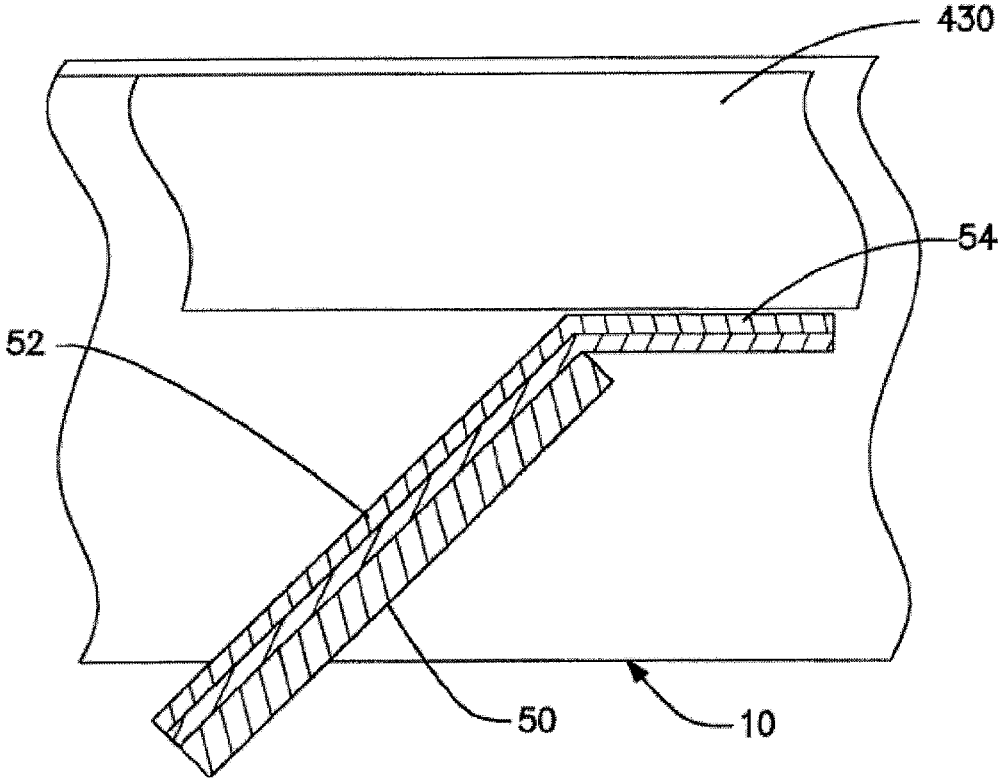
FIG. 6 is a side elevational view partially in section and on an enlarged scale of a portion of the primary classifier constructed in accordance with the present invention of FIG. 4.

Turning now to a consideration of the primary classifier 300 constructed in accordance with the present invention, reference will be had for this purpose particularly to FIG. 4, FIG. 5 and FIG. 6 of the drawings. The principal function of the primary classifier 300 is to manage the direction and velocity of the flow of air at the location within the substantially closed separator body 12 of the bowl mill 10, constructed, by way of exemplification and not limitation, preferably in the manner that has been described herein previously and which can be found illustrated in FIG. 3 of the drawings, whereat the particles of coal, which have been subjected to pulverization as a result of the cooperative action between the grinding rolls 18 of the bowl mill 10 and the surface of the grinding table 14 of the bowl mill 10, become entrained in the flow of air that flows upwardly in the space 32 that is provided for this purpose between the circumference of the grinding table 14 and the interior of the substantially closed separator body 12 of the bowl mill 10. In a manner yet to be described herein, the primary classifier 300 constructed in accordance with the present invention also is operative to create a physical barrier to unwanted spillage of the particles of coal that have been subjected to pulverization as a result of the cooperative action of the grinding rolls 18 of the bowl mill 10 and the surface of the grinding table 14 of the bowl mill 10. This is accomplished by virtue of the fact that the primary classifier 300 constructed in accordance with the present invention is further operative to cause the particles of coal, as these particles of coal leave the surface of the grinding table 14 of the bowl mill 10, to flow upwardly in the direction of flow of the flow of air as the flow of air exits from the space 32, which is provided between the circumference of the grinding table 14 of the bowl mill 10 and the interior of the substantially closed separator body 12 of the bowl mill 10, after the flow of air has passed through the space 32.

As best understood with reference to FIG. 4 of the drawings, the primary classifier 300 constructed in accordance with the present invention includes a vane wheel portion, generally designated in the drawings by the reference numeral 360, and a low profile deflector portion, generally designated in the drawings by the reference numeral 380. The vane wheel portion 360 of the primary classifier 300 constructed in accordance with the present invention, in a manner that will be described more fully hereinafter, is constructed so as to extend circumferentially around the entire interior of the substantially closed separator body 12 of a pulverizer-type bowl mill that embodies a prior art form of construction, such as by way of exemplification and not limitation, the bowl mill 10, which has been described herein previously and which is illustrated in FIG. 3 of the drawings. Continuing, in accordance with the present invention, the vane wheel portion 360 of the primary classifier 300 is designed to be suitably affixed to the periphery, i.e., the circumference, of the grinding table 14 of the bowl mill 10, the bowl mill 10 being constructed as illustrated in FIG. 3 of the drawings, by means of any conventional form of fastening means suitable for use for such a purpose. To this end, there are two standard methods that are most frequently employed for purposes of accomplishing the affixing of the vane wheel portion 360 of the primary classifier 300 to the periphery, i.e., circumference, of the grinding table 14 of the bowl mill 10. The first of these two standard methods is commonly referred to as the "direct bolt on" method. In accordance therewith, as best understood with reference to FIG. 5 of the drawings, the individual segments which collectively comprise the vane wheel portion 360 of the primary classifier 300, are bolted on to the periphery of the grinding table 14 of the bowl mill 10 through the use of conventional threaded fasteners, only one of which, for purposes of maintaining clarity of illustration in the drawings, is depicted in FIG. 5 of the drawings, wherein this threaded fastener is denoted therein by the reference numeral 420. The second of these two standard methods is commonly referred to as the "floating pin" method. In accordance with the second of these two standard methods, i.e., the "floating pin" method (not shown in the interest of maintaining clarity of illustration in the drawings), pins/spacers would be fastened to the periphery, i.e., circumference, of the grinding table 14 of the bowl mill 10 and would be made to project though holes that would be provided for this purpose in the inner ring of the vane wheel portion 360 of the primary classifier 300. The individual segments, which collectively comprise the vane wheel portion 360 of the primary classifier 300, would be welded together so as to create therefrom a solid 360° ring extending around the entire circumference of the grinding table 14 of the bowl mill 10 and this solid 360° ring portion of the vane wheel portion 360 would be allowed to float on the aforementioned pins/spacers. This second of the two standard methods for affixing the vane wheel portion 360 to the periphery of the grinding table 14 of the bowl mill 10 possesses several advantages; namely, it eliminates the need for ensuring that the circumference of the grinding table 14 of the bowl mill 10 embodies a good mating surface and by virtue of the floating action associated therewith it avoids the problem of thermal growth issues.

Continuing with the description of the vane wheel portion 360 of the primary classifier 300 constructed in accordance with the present invention, reference will be had for this purpose in particular to FIG. 6 of the drawings. To this end, as best understood with reference to FIG. 5 of the drawings, the vane wheel 360 of the primary classifier 300 constructed in accordance with the present invention includes a steel inner ring referred to as the inner shroud and denoted in the drawings by the reference numeral 435, and a steel outer ring referred to as the outer shroud and denoted in the drawings by the reference numeral 440. In accordance with the best mode embodiment of the present invention, preferably approximately thirty steel vanes, each such vane being denoted in the drawings by the reference numeral 50, are suitably positioned around the circumference of the grinding table 14 of the bowl mill 10 so as to be equally spaced with approximately six such vanes 50 being associated with each segment of the vane wheel portion 360 of the primary classifier 300. As best understood with reference to FIG. 6 of the drawings, the vanes 50 are operative to effect an interconnection of the inner shroud 435 of the vane wheel portion 360 of the primary classifier 300 with the outer shroud 440 of the vane wheel portion 360 of the primary classifier 300.

Also, the vane wheel portion 360 of the primary classifier 300 constructed in accordance with the present invention is usually provided, as best understood with reference to FIG. 6 of the drawings, with abrasion resistant liners, denoted in the drawings by the reference numeral 52. The abrasion resistant liners 52, which as illustrated in FIG. 6 of the drawings are equipped with horizontal plates, denoted in the drawings by the reference numeral 54, are designed to be operative to protect the vanes 50 from the wear that would otherwise be incurred from the vanes 50 being struck by particles of coal that are entrained in the flow of air as the flow of air flows upwardly through the vane wheel portion 360, which is located in the space 32 of the bowl mill 10. With further reference to the abrasion resistant liners 52 equipped with the horizontal plates 54, the horizontal plate 54 portion of the abrasion resistant liners 52 is most often referred to as the "wing tips", and it is the length of these wing tips, which function as the means by which control is had over the free area of the vane wheel portion 360 of the primary classifier 300 constructed in accordance with the present invention. The velocity of the flow of air as the flow of air passes through the vane wheel portion 360 of the primary classifier 300 as the flow of air flows upwardly through the space 32 provided for this purpose in the bowl mill 10 is in turn established by the length of the aforedescribed wing tips.

Continuing, the vane wheel portion 360 of the primary classifier 300 may, if so desired, without departing from the essence of the present invention, be provided, as best understood with reference to FIG. 5 of the drawings, with a set of additional liners commonly referred to as being the vane wheel inner shroud liner, denoted in the drawings by the reference numeral 430. In accordance with the present invention, one such vane wheel inner shroud liner 430 is provided, in mounted relation thereto by means of any conventional form of mounting means suitable for use for such a purpose, per each segment of the vane wheel portion 360 of the primary classifier 300 constructed in accordance with the present invention thereby resulting in full 360° protection of the inner shroud 435 and fasteners 420, which are located above the abrasion resistant liners 52 with which the vanes 50 are provided. Normally, however, the vane wheel inner shroud liners 430 are preferably in accordance with the best mode embodiment of the invention mounted by being welded in place after the vane wheel portion 360 of the primary classifier 300 has been affixed to the grinding table 14 around the outer periphery thereof.

Figure 1:
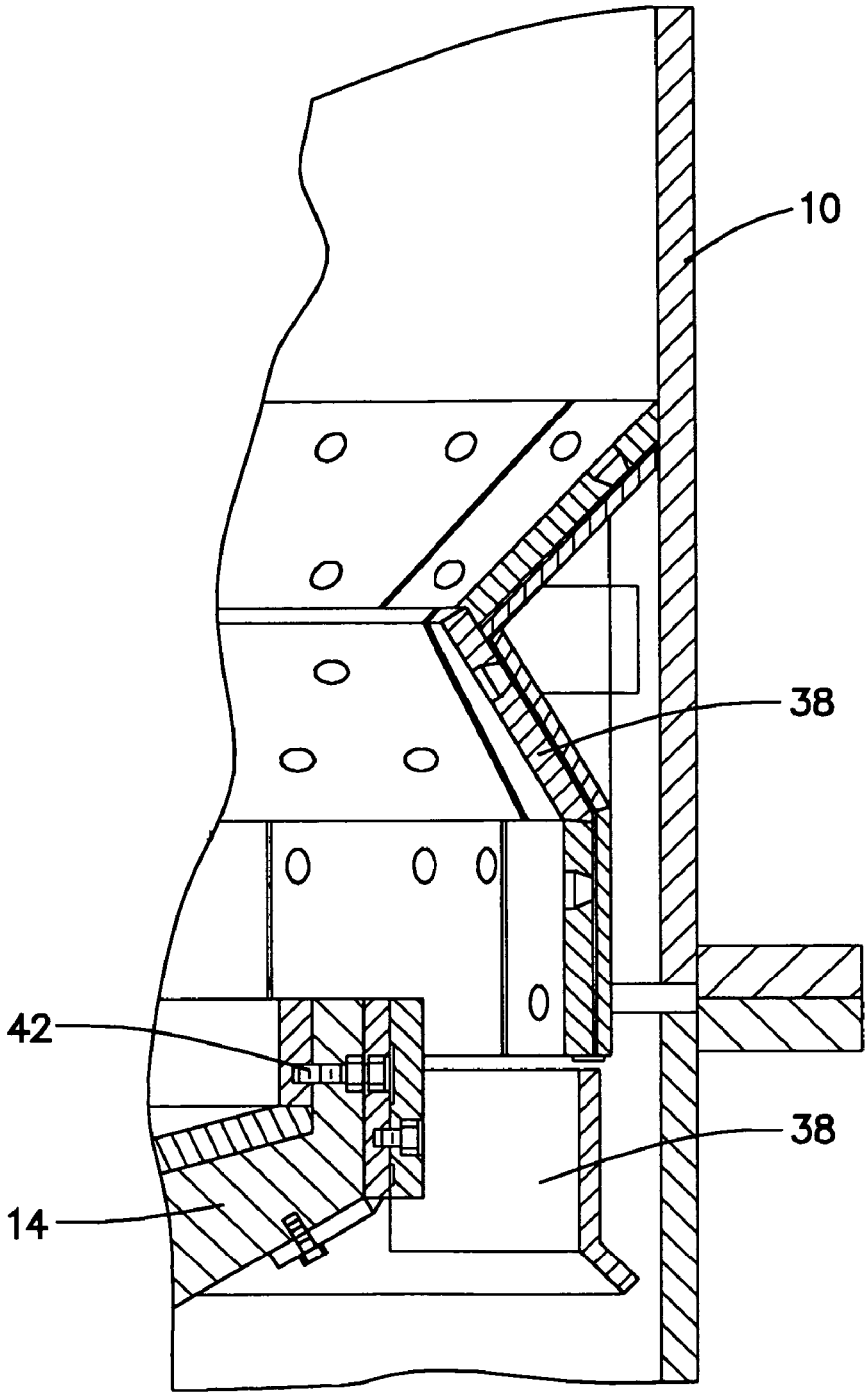
Figure 1 (Prior Art)
FIG. 1 is a first partial side elevation view of a portion of a prior art primary classifier of a bowl mill type pulverizer.
Figure 2:
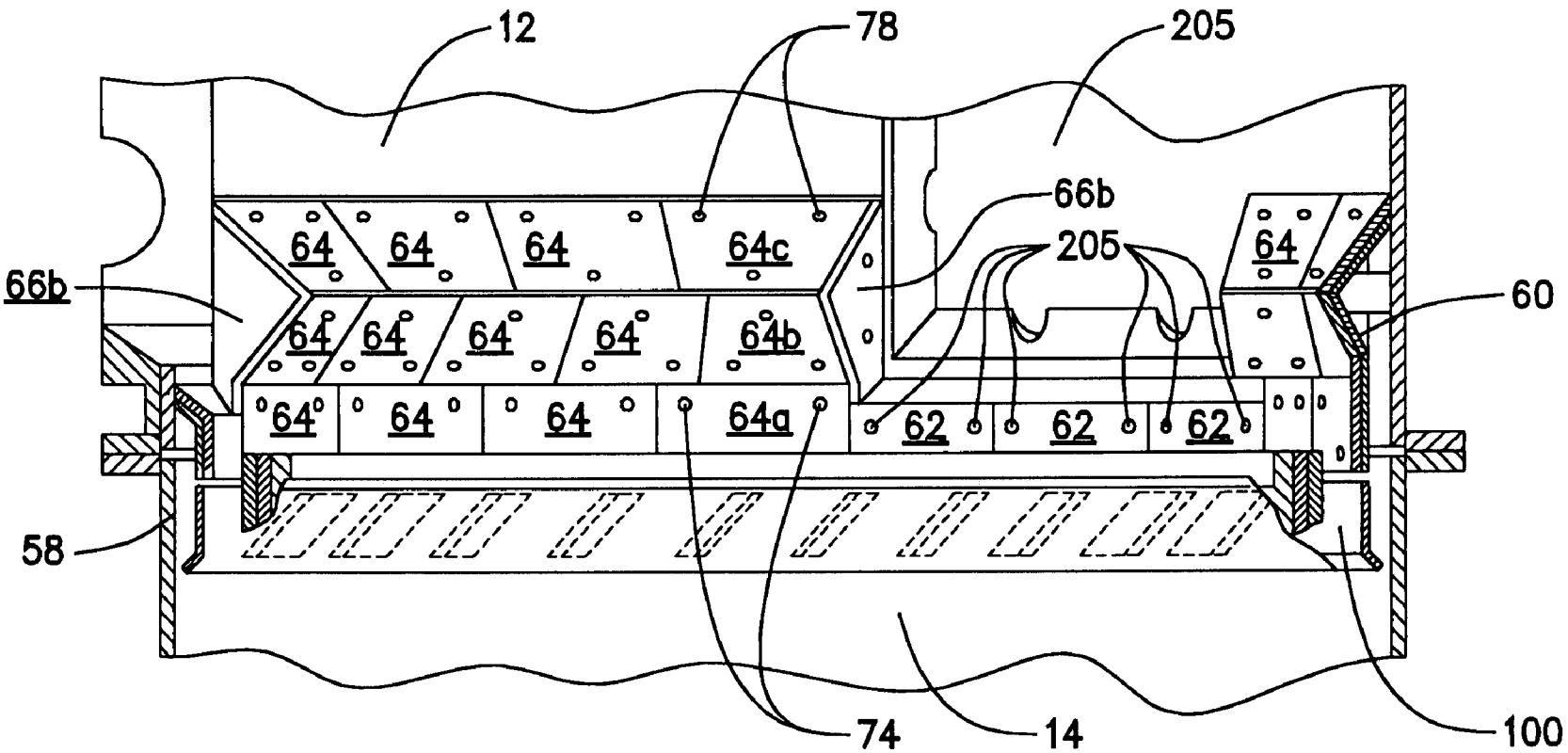
Figure 2 (Prior Art)
FIG. 2 is a second side elevation view of the prior art form of primary classifier of the bowl mill type pulverizer of FIG. 1.

A description will now be had herein of the low profile deflector portion 380 of the primary classifier 300 constructed in accordance with the present invention. For this purpose, reference will be had in particular to FIGS. 4 and 5 of the drawings. The low profile deflector portion 380 of the primary classifier 300 is in accordance with the present invention mounted within the interior of the substantially closed separator body 12 of the bowl mill 10 constructed as has been described herein previously and as is illustrated in FIG. 3 of the drawings in closely spaced relation to the surface of the grinding table 14 of the bowl mill 10. This mounting of the low profile deflector portion 380 of the primary classifier 300 constructed in accordance with the present invention is in contrast to the manner in which the prior art type of non-continuous deflector to which reference has been had hereinbefore is mounted. More specifically, the low profile deflector portion 380 of the primary classifier 300 constructed in accordance with the present invention is mounted at an elevation in the substantially closed separator body 12 of the bowl mill 10 below the elevation at which the grinding journal openings/doors 205 are located, as has been illustrated, for example, in FIG. 2 of the drawings. Thus, unlike the prior art type of non-continuous deflector that is illustrated in FIGS. 2 and 3 of the drawings, the low profile deflector portion 380 of the primary classifier constructed in accordance with the present invention is, therefore, continuous about the interior of the substantially closed separator body 12 of the bowl mill 10, as the low profile deflector portion 380 does not have to have sections thereof omitted for purposes of thereby creating open areas to accommodate the grinding journal openings/doors 205.

The low profile deflector portion 380 of the primary classifier 300 constructed in accordance with the present invention encompasses the following components: upper liners, denoted in the drawings by the reference numeral 401, middle liners, denoted in the drawings by the reference numeral 405, and lower liners, denoted in the drawings by the reference numeral 410. In accordance with the best mode embodiment of the invention, each of the liners 401, 405, and 410 is preferably affixed through the use of any conventional form of fastening means suitable for use for this purpose directly to the inner wall of the substantially closed separator body 12 of the bowl mill 10, thereby eliminating the need for employing any type of support plate components. The affixing of the liners 401, 405 and 410 to the inner wall of the substantially closed separator body 12 of the bowl mill 10 could, for example, be accomplished by means of by welding or bolting, although other forms of fastening means could also be utilized, as desired, without departing from the essence of the present invention. Preferably, the liners 401, 405, and 410, in accordance with the best mode embodiment of the invention, are made of an abrasion resistant material that is suitable for use for such a purpose.

The upper liners 401, as best understood with reference to FIG. 5 of the drawings, are in their mounted state affixed to the inner wall of the substantially closed separator body 12 of the bowl mill 10 angled downwardly, preferably at a 45° angle, to thereby be operative to effect the shedding of any particles of coal, which might otherwise settle on the exposed surface of the upper liners 401. Such particles of coal, which are shed from the upper liners 401 again upon being so shed therefrom become entrained in the flow of air that flows in an upwardly direction through the free area of the vane wheel portion 360 of the primary classifier 300 constructed in accordance with the present invention. The middle liners 405, as best understood with reference to FIG. 5 of the drawings, in their mounted state affixed to the inner wall of the substantially closed separator body 12 of the bowl mill 10 are angled inwardly to direct the flow of air that flows through the free area of the vane wheel portion 360 of the primary classifier 300 constructed in accordance with the present invention in an inwardly direction back over the grinding table 14 of the bowl mill 10. Lower edges 426 of the middle liners 405 are positioned below an upper rim 425 of the grinding table 14, thus allowing the middle liners 405 to direct air flowing through the free area of the vane wheel portion 360, which is indicated at A1, toward the upper rim 425 of the grinding table 14 and back onto the grinding surface to prevent coal particles from spilling over the rim 425 where they could cause erosion of the vane wheel 360. In the example shown, the upper rim 425 of the grinding table 14 is effectively formed by an upper edge of the inner shroud 435.

Furthermore, air flowing from the free area A1 of the vane wheel portion passes through a free area A2 between the upper rim 425 of the grinding table 14 and the middle liner 405. As can be seen in FIG. 5, the area A1 is greater than the area A2, thus creating a converging nozzle that prevents a decrease in air velocity as the air passes between the rim 425 of the grinding table 14 and the middle liner 405. The air velocity at the rim 425 directs larger coal particles back onto the grinding table 14 and helps to prevent these particles from falling below the outer edge of the grinding table 14 where they could cause erosion of the vane wheel 360. Once the flow of air that has traveled through the free area of the vane wheel portion 360 of the primary classifier 300 over the grinding table 14 of the bowl mill 10, this flow of air undergoes a drastic drop in velocity thereby causing the larger particles of coal, which have become entrained in this flow of air to return to the grinding table 14 of the bowl mill 10.

As will be understood by one of ordinary skill in the art, as well as from the discussion above, those particles of coal, which have been pulverized to the desired size are then carried entrained therewith by the flow of air up to the classifier 28 of the bowl mill 10. The flow up to the classifier 28 of the bowl mill 10 of this flow of air within which the particles of coal that have been pulverized to the desired size are entrained takes place in essentially the same manner as such a flow of air with particles of coal entrained therein does in the case when existing prior art types of primary classifiers are being employed. Thus, the primary classifier 300 constructed in accordance with the present invention is capable of being employed with existing prior art types of bowl mills without any difficulty irrespective of whether a dynamic classifier or a static classifier is being employed in such prior art types bowl mills.

Continuing, the low profile deflector portion 380 of the primary classifier 300 constructed in accordance with the present invention is operative to deflect the flow of air from the free area of the vane wheel portion 360 of the primary classifier 300 before the particles of coal are fully entrained in this flow of air, thereby enabling similar flow patterns to be achieved in the bowl mill 10 in which the primary classified 300 constructed in accordance with the present invention has been installed as those that exist in prior art forms of bowl mills that are equipped with prior art forms of primary classifiers, with much less internal wear of the bowl mill 10, which is equipped with the primary classifier 300 constructed in accordance with the present invention. Thus, with the low profile deflector portion 380 of the primary classifier 300 constructed in accordance with the present invention being mounted so as to be affixed directly to the inner wall of the substantially closed separator body 12 of the bowl mill 10 just over the vane wheel portion 360 of the primary classifier 300, particles of coal are kept away from the vane wheel portion 360 of the primary classifier 300, thereby not only reducing the wear to which the vane wheel portion 360 of the primary classifier 300 is subjected, but also minimizing the amount of spillage of particles of coal that is allowed to occur.

The primary classifier 300 constructed in accordance with the present invention as described herein and as illustrated in particular in FIGS. 4, 5 and 6 of the drawings also provides for both ease of installation as well as reduced cost compared to the ease of installation and cost of the prior art forms of primary classifiers that have been employed heretofore in accordance with the prior art in pulverizer-type bowl mills. This is largely attributable to the fact that the low profile deflector portion 380 of the primary classifier 300 constructed in accordance with the present invention is continuous in nature for a full 360°, and thus because no side liners and no support plates need to be utilized with the primary classifier 300 of the present invention.

The present invention is not to be limited in scope by the specific embodiments described herein. Indeed, various modifications of the present invention, in addition to those described herein, will be apparent from the foregoing description and accompanying drawings to those who are skilled in this art. Thus, such modifications are intended to fall within the scope of the appended claims.

What is claimed is:

1. A bowl mill comprising:

a substantially closed separator body;

a rotatable grinding surface mounted for rotation within the substantially closed separator body and upon which pulverization of material is effected;

a plurality of grinding rolls for pulverizing the material on the rotatable grinding surface, the plurality of grinding rolls being supported by a plurality of grinding journals;

an annular passage formed between the substantially closed separator body and the circumference of the rotatable grinding surface through which air is made to flow in an upwardly direction;

a plurality of grinding journal openings formed in the substantially closed separator body, each grinding journal opening associated with one of the plurality of grinding journals;

a vane wheel portion affixed to the periphery of the rotatable grinding surface, the vane wheel portion including a plurality of vanes; and a low profile deflector portion mounted within the interior of the substantially closed separator body in closely spaced relation to the vane wheel portion at an elevation below the elevation of the grinding journal openings and so as to extend continuously without interruption about the entire interior of the substantially closed separator body.

2. The primary bowl mill of claim 1 further comprising a plurality of abrasion resistant liners, each of the plurality of abrasion resistant liners being provided on a respective one of the plurality of vanes so as to protect the respective one of the plurality of vanes from wear.

3. The primary bowl mill of claim 2 wherein the plurality of abrasion resistant liners are each equipped with a horizontal plate, wherein the length of the horizontal plates affects the velocity of the flow of air passing through a free area of the vane wheel portion.

4. The bowl mill of claim 1, wherein the deflector portion includes:

a plurality of upper liners affixed directly to the inner wall of the substantially closed separator body, the plurality of upper liners are angled downwardly so as to thereby accomplish the shedding of any pulverized material that might otherwise accumulate on the plurality of upper liners; and a plurality of middle liners affixed to the inner wall of the substantially closed separator body and disposed beneath the plurality of upper liners, wherein the plurality of middle liners are angled downwardly so as to thereby direct the flow of air that flows through a free area of the vane wheel portion in an inwardly direction back over the grinding surface.

5. The bowl mill of claim 4 wherein the plurality of upper liners and the plurality of middle liners are each formed of an abrasion resistant material.

6. The bowl mill of claim 4, wherein lower edges of the middle liners are positioned below an upper rim of the rotatable grinding surface to direct the flow of air toward the upper rim of the rotatable grinding surface.

7. The bowl mill of claim 6, wherein the free area of the vane wheel portion is greater than a free area defined between the upper rim of the rotatable grinding surface and the middle liners, thus creating a converging nozzle that prevents a decrease in air velocity as the flow of air passes between the upper rim of the grinding table and the middle liner.

8. The bowl mill of claim 6, wherein the plurality of vanes are disposed between an inner shroud and an outer shroud, the inner shroud being attached around the circumference of the rotatable grinding surface to form the upper rim of the rotatable grinding surface.

9. The bowl mill of claim 6, further comprising a plurality of lower liners extending downwardly from the lower edges of the middle liners.

10. A primary classifier for a rotatable grinding surface of a bowl mill, the primary classifier comprising:

a vane wheel portion including a plurality of vanes disposed fixed around the circumference of the rotatable grinding surface; and a stationary deflector portion disposed around the vane wheel portion, the deflector portion including:

a plurality of upper liners angled downwardly to shed any pulverized material that might otherwise accumulate on the plurality of upper liners, and a plurality of middle liners positioned below the upper liners and angled downwardly so as to thereby direct a flow of air that flows through a free area of the vane wheel portion in an inwardly direction back over the grinding surface, wherein lower edges of the middle liners are positioned below an upper rim of the rotatable grinding surface to direct the flow of air toward the upper rim of the rotatable grinding surface and thereby prevent coal particles from spilling over the upper rim.

11. The primary classifier of claim 10, wherein the free area of the vane wheel portion is greater than a free area defined between the upper rim of the rotatable grinding surface and the middle liners, thus creating a converging nozzle that prevents a decrease in air velocity as the flow of air passes between the upper rim of the grinding table and the middle liner.

12. The primary classifier of claim 10, wherein the plurality of vanes are disposed between an inner shroud and an outer shroud, the inner shroud being attached around the circumference of the rotatable grinding surface to form the upper rim of the rotatable grinding surface.

13. The bowl mill of claim 10, further comprising a plurality of lower liners extending downwardly from the lower edges of the middle liners.

* * * * *